United States Patent [19]

McMillian

[11] Patent Number: 4,834,661

[45] Date of Patent: May 30, 1989

[54] BUSY-OUT LINE CONNECTOR

[75] Inventor: Lonnie S. McMillian, Huntsville, Ala.

[73] Assignee: Universal Data Systems, Inc., Huntsville, Ala.

[21] Appl. No.: 136,451

[22] Filed: Dec. 22, 1987

Related U.S. Application Data

[63] Continuation of Ser. No. 749,484, Jun. 27, 1985, abandoned.

[51] Int. Cl.[4] ..... H01R 31/08

[52] U.S. Cl. ..... 439/512; 439/636; 439/676

[58] Field of Search ..... 439/638–655, 439/344, 676, 629–637, 507, 509, 512, 513

[56] References Cited

U.S. PATENT DOCUMENTS

| | | | |
|---|---|---|---|
| 1,825,208 | 9/1931 | Rumble | 339/19 |
| 1,984,036 | 12/1934 | Schwartzmann | 175/21 |
| 2,294,482 | 1/1942 | Siegmund | 200/166 |
| 2,312,002 | 2/1943 | Schmitt | 173/328 |
| 2,908,775 | 10/1959 | Gilbert | 220/2 |
| 3,137,537 | 6/1964 | Cole et al. | 339/176 |
| 3,205,471 | 9/1965 | Herrmann | 339/176 |
| 3,315,218 | 4/1967 | Aker | 339/191 |
| 3,482,201 | 12/1969 | Schneck | 339/14 |
| 3,617,990 | 11/1971 | Colardeau | 339/177 E |
| 3,639,888 | 2/1972 | Pittman et al. | 339/75 MP |
| 3,660,803 | 5/1972 | Cooney | 339/176 MP |
| 3,850,497 | 11/1974 | Krumrelch et al. | 339/126 R |
| 3,903,385 | 9/1975 | Moyer et al. | 339/19 |
| 3,954,320 | 5/1976 | Hardesty | 339/99 R |
| 4,070,557 | 1/1978 | Ostapovitch | 200/51.1 |
| 4,106,841 | 8/1978 | Vladic | 339/176 M |
| 4,175,818 | 11/1979 | Kourimsky et al. | 339/176 MP |
| 4,179,173 | 12/1979 | Rise, III | 339/19 |
| 4,221,458 | 9/1980 | Hughes et al. | 339/126 R |
| 4,274,691 | 6/1981 | Abernethy et al. | 339/19 |
| 4,290,664 | 9/1981 | Davis et al. | 339/156 R |
| 4,460,234 | 7/1984 | Bogese | 339/128 |
| 4,497,526 | 2/1985 | Myers | 339/17 LC |
| 4,514,030 | 4/1985 | Triner et al. | 339/176 MP |
| 4,602,842 | 7/1986 | Free et al. | 339/156 R |

OTHER PUBLICATIONS

"Electrical Adapter Connector", R. R. Goodrich, Technical Digest No. 74, Jul. 1984, pp. 13–14.

*Primary Examiner*—David Pirlot

*Attorney, Agent, or Firm*—Charles L. Warren

[57] ABSTRACT

A unitary connector for providing a connection between a printed circuit board edge connector and a telephone line jack, wherein a busy-out line condition is indicated when the printed circuit card is removed from the connector according to the present invention. The connector includes a female printed circuit board edge connector and a female telephone connector, each having the appropriate resilient connectors therein and paths for conduction between the two respective connectors. Moreover, the printed circuit board edge connector includes a plurality of electrically independent resilient contacts arranged in opposing rows, wherein at least one contact of one of the rows engages the respective opposing contact in the second row. The two engaged contacts are connected to the appropriate telephone jack pin to provide a busy-out condition indication.

7 Claims, 2 Drawing Sheets

BUSY-OUT LINE CONNECTOR

This is a continuation of application Ser. No. 749,484, filed 6/27/85 now abandoned.

FIELD OF THE INVENTION

The present invention relates to telephone line connectors, and in particular telephone line connectors providing a busy-out indication.

BACKGROUND OF THE INVENTION

In previous interconnection between equipment, such as between when computer modems are removed from the telephone equipment circuit, the corresponding telephone jack signals remain open. As a result the circuit appears to be ready for communication. However, a more appropriate condition would be a busy-out condition. The approach necessary to produce a busy-out condition is typically a shorted contact between the appropriate pair of wires. Therefore, the busy-out condition has been accomplished by manual shorting of the contacts or designation by the appropriate control equipment that the circuit is not available for communication and the card has been removed. As a result of the added complexity, the decreased reliability, and the added confusion which results in such manual interventions makes it difficult to maintain a reliable communication systems.

SUMMARY OF THE INVENTION

The present application provides an automatic busy-out condition upon removal of a respective circuit board from the circuit to which a telephone jack is connected. The busy-out condition is provided by a short circuit between two confronting printed circuit board connector contact pins, as required and designated within each particular system. Upon reinsertion of the respective printed circuit card, the jack again provides the appropriate interconnection, and the system resumes normal operation.

The particular features of the present invention include a unitary connector having a housing including both a female telephone connector and female printed circuit board edge connector. The unitary connector includes interconnection between both female connectors wherein a contact from the telephone connection is formed from the same material of the printed circuit board connector contact. The female printed circuit board edge connector comprises a double row of contacts registered in opposition to receive the printed circuit board edge contacts on either side thereof, wherein at least one of the upper contacts and one of the lower contacts becomes engaged upon removal of the printed circuit board from the female printed circuit board edge connector. The contacts engaged by removal of the printed circuit board are each connected to a contact in the female telephone connector included within the unitary connect housing to provide a busyout circuit.

BRIEF DESCRIPTION OF THE DRAWING

These and other features of the present invention will be better understood by reading the following detailed description, taken together with the following drawing, wherein.

DETAILED DESCRIPTION OF THE INVENTION

Figure 1:
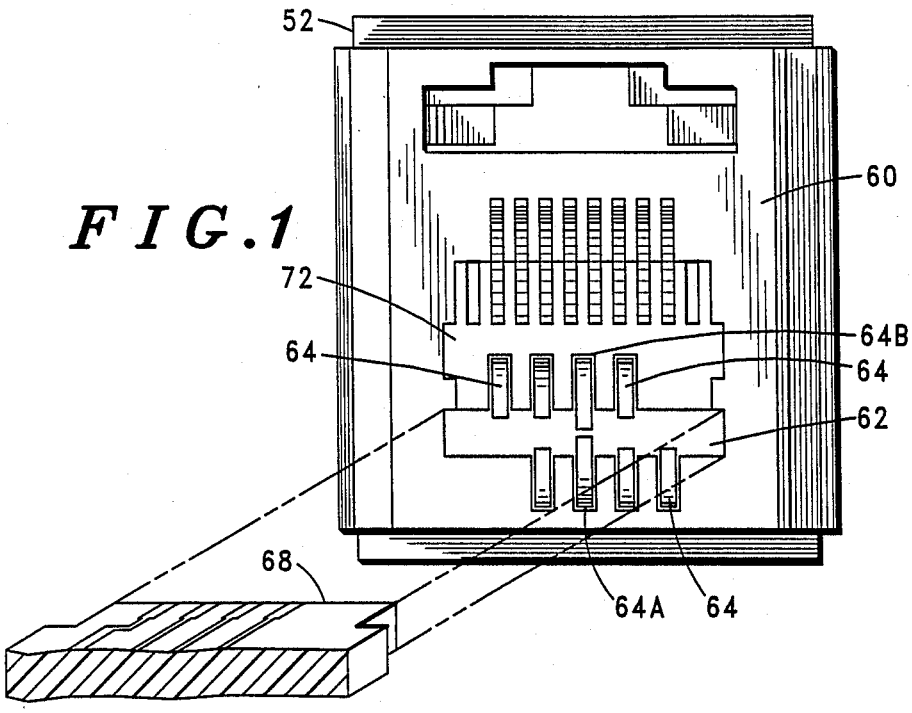
FIG. 1 is a front view of the connector according to one embodiment of the present invention.
Figure 2:
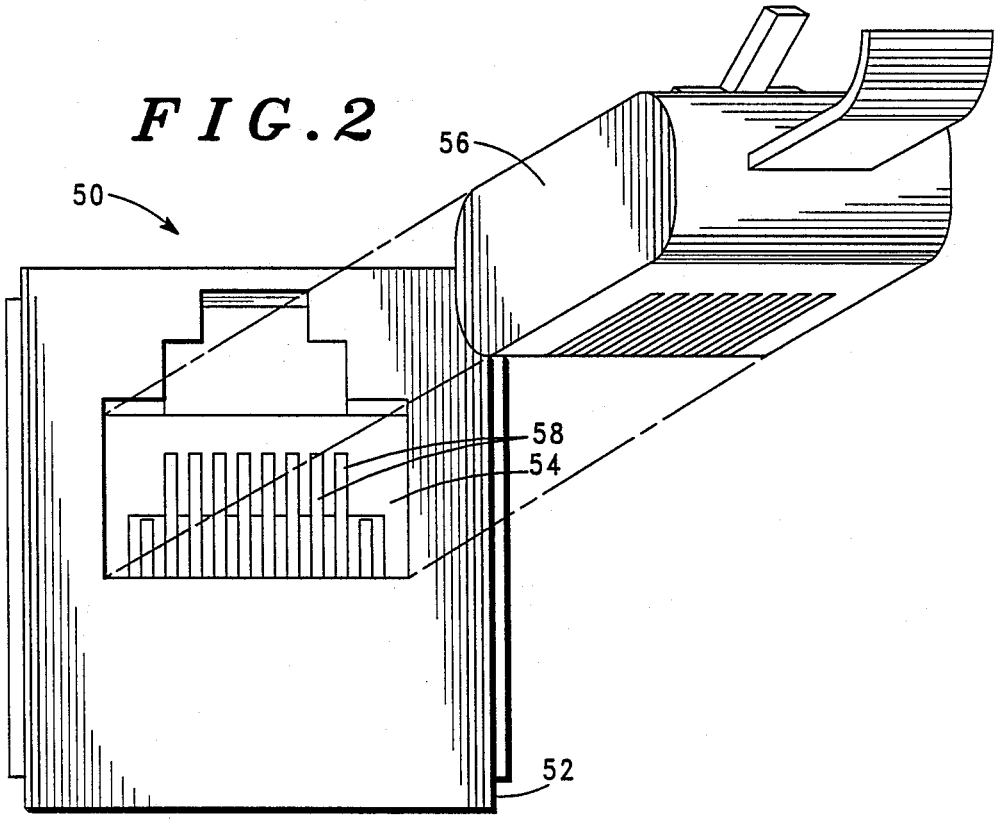
FIG. 2 is a rear view of the connector embodied as shown in FIG. 1.

The unitary connector 50 of FIG. 1 according to the present invention includes a single housing 52 having an opening 54 to receive the telephone clip plug 56 therein. The telephone clip plug 56 is known in the art and available from several manufacturers. The phone clip plug opening forms a female connector having a plurality of upstanding resilient spring contacts 58 formed to engage the contacts within the phone clip plug. The upstanding resilient spring phone clip plug contacts 58 extend to the rear of the connector at 60 (FIG. 2), wherein the opening to the printed circuit board edge connector 62 is also shown. The printed circuit board edge connector includes a plurality of resilient contact members 64 arranged in two rows registered in opposition to engage edge connector contacts on each side of the printed circuit board edge 68. Of particular interest is that at least one contact of the lower row 64A engages the corresponding upper contact 64B when the printed circuit board is removed from the opening.

Figure 3:
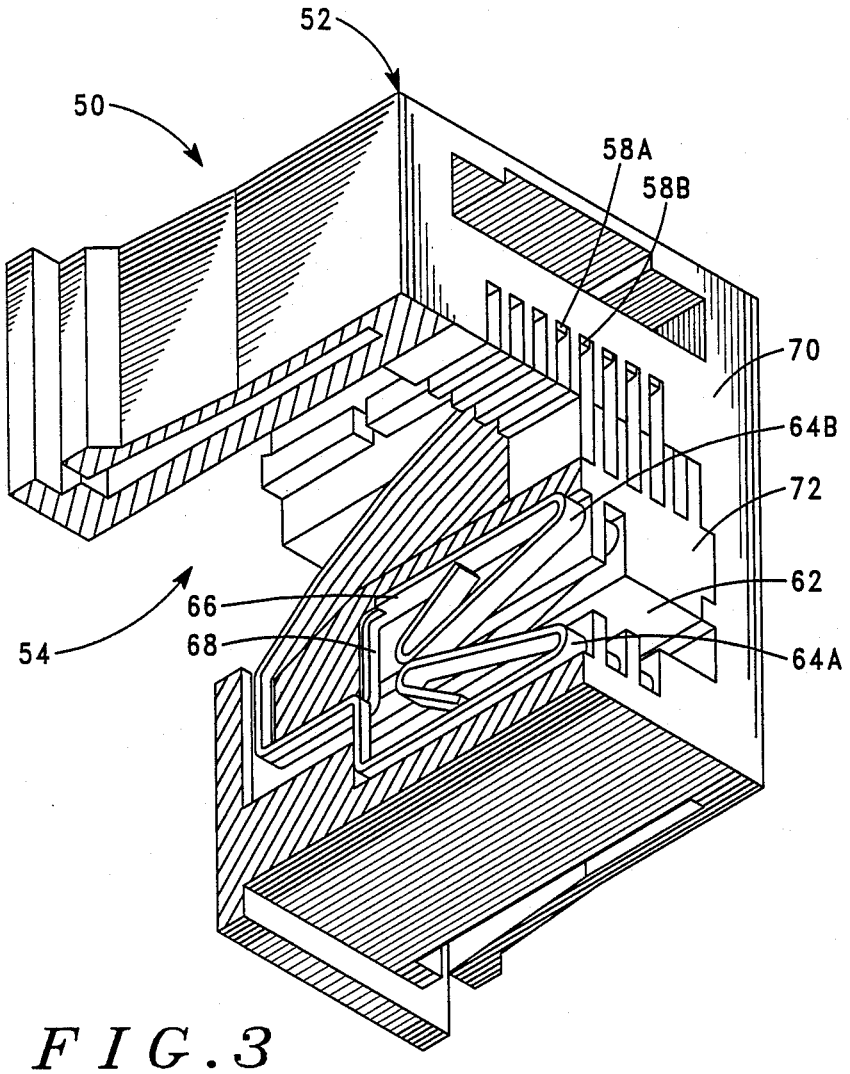
FIG. 3 is a perspective cut-away drawing showing the busy-out condition and the interconnection between the telephone and printed circuit connectors.

The printed circuit board connector contacts 64A and 64B are connected to the particular phone clip resilient contacts 58A and 58B, as shown in FIG. 3. The interconnections are made within the plug housing, which may be separated into a separate outer housing 70 and a removable inner member 72. Since the rear 66 of the printed circuit board connector contacts is wider (typically twice as wide) than the contacts 58, the direct connection between alternate opposing contacts (such as 64A and 64B) is accommodated by a lateral offset at the transition at 68. The contacts 58 are partially bent around the inner connector member 72 to allow the contacts to be resilient against the plug 56 (when inserted) and to align within grooves of the housing 72 and the member 70. When the inner connector member element 72 receives the contacts 64(58) and is inserted into the outer housing 70 to complete the assembly, the contacts for the telephone and printed circuit board connector are interconnected.

Modifications, substitutions, and alternate embodiments made by one skilled in the art is within the scope of the present invention, which is not to be limited except by the claims which follow.

What is claimed is:

1. A unitary connector comprising:

a female telephone connector having a plurality of resilient contacts adapted to mate with corresponding contacts in a telephone cable plug;

a female printed circuit board edge connector having a plurality of resilient contacts arranged in opposition along a first and second row to mate with contacts on a printed circuit board;

means for automatically providing a busy indication to said telephone cable plug when said printed circuit board is not engaged with said edge connector, said means comprising a single one of the contacts in said first row engaging a corresponding contact in registration therewith in the second row upon removal of the printed circuit board from said edge connector, each of said telephone connector contacts integrally formed as part of one of said edge connector contacts; and a housing formed to include said female telephone connector and said female printed circuit board edge connector.

2. The connector according to claim 1, wherein said telephone connector contacts consist of adjacent sequential contacts, said one contact in said first row also comprising a given contact in said telephone connector contacts, said contact in said second row in registration with said one contact comprising a telephone connector contact adjacent said given contact, whereby at least two adjacent telephone connector contacts are electrically connected when said printed circuit board does not engage said edge connector.

3. A unitary connector comprising:

a housing having an aperture in a first wall of the housing for receiving a telephone cable plug and an aperture in a second wall of the housing opposite said first wall for receiving a printed circuit board with edge contacts;

a plurality of integrally formed contacts, each connecting said cable plug with said printed circuit board edge;

means for automatically providing a busy indication to said telephone cable plug when said printed circuit board does not engage said integrally formed contacts;

a predetermined pair of said plurality of contacts make mutual electrical contact with each other when said printed circuit board is not engaged, and said mutual electrical contact is broken when said printed circuit board is engaged in the respective housing aperture.

4. The unitary connector of claim 3, wherein said plurality of contacts is disposed to engage both sides of said printed circuit board in opposition, and at least two of said contacts in opposition comprise said contacts which make electrical contact.

5. The connector according to claim 3, wherein said plurality of integrally formed contacts comprise a series of adjacent spaced apart contacts for engaging corresponding contacts of said telephone cable plug, and first and second rows of opposing contacts located to engage said printed circuit board edge contacts, a first contact in said first row also comprising a given contact in said series of contacts, a second contact in said second row of contacts disposed opposite said first contact also comprising a contact in said series of contacts adjacent said given contact.

6. In equipment constructed to receive a plug-in modem contained on a printed circuit board having an edge portion with contacts formed on said edge portion, the improvement comprising:

a unitary connector mounted to said equipment and including a housing having an aperture in a first wall for receiving a telephone cable plug and an aperture in a second wall opposite said first wall for receiving said edge portion of the printed circuit board, said connector having a plurality of integrally formed contacts for connecting contacts on said cable plug with said contacts on the edge portion of the printed circuit board, means for automatically providing a busy indication to said telephone cable plug when said edge portion of the printed circuit board is not inserted in said aperture in said second wall, a predetermined pair of said plurality of contacts make mutual electrical contact with each other when said edge portion of the printed circuit board is not engaged, and said mutual electrical contact is broken when said edge portion of the printed circuit board is engaged in the respective housing aperture.

7. In the equipment according to claim 6, the unitary connector further comprising a series of adjacent spaced apart contacts for engaging corresponding contacts of said telephone cable plug, and first and second rows of opposing contacts located to engage said printed circuit board edge contacts, a first contact in said first row also comprising a given contact in said series of contacts, a second contact in said second row of contacts disposed opposite said first contact also comprising a contact in said series of contacts adjacent said given contact.

* * * * *